US006220721B1

(12) United States Patent
Chan et al.

(10) Patent No.: US 6,220,721 B1
(45) Date of Patent: Apr. 24, 2001

(54) MULTI-LYTE CHANNEL LIGHTING SYSTEM

(75) Inventors: Kingsley Chan, Tustin; Fred Nourishad, Irvine; Juan Lizarde, Chino Hills, all of CA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/067,898

(22) Filed: Apr. 28, 1998

(51) Int. Cl.[7] ..... F21S 4/00

(52) U.S. Cl. ..... 362/219; 362/225; 362/231; 362/404

(58) Field of Search ..... 362/217, 219, 362/221, 225, 229, 231, 391, 404, 147

(56) References Cited

U.S. PATENT DOCUMENTS 2,291,490 * 7/1942 Naysmith ..... 362/225
3,075,072 * 1/1963 Gibson et al. ..... 362/219
3,123,310 * 3/1964 Damerul ..... 362/221
4,688,154 * 8/1987 Nilssen ..... 362/404
4,979,081 * 12/1990 Leach et al. ..... 362/219
4,980,808 * 12/1990 Lilos ..... 362/219
4,994,943 * 2/1991 Aspenwall ..... 362/217
5,025,355 * 6/1991 Harwood ..... 362/225
5,568,969 * 10/1996 Yu ..... 362/147

* cited by examiner

*Primary Examiner*—Sandra O'Shea
*Assistant Examiner*—Peggy G Neils

(57) ABSTRACT

A unitary lighting system that provides both general and track or accent lighting includes at least one mounting channel with first and second compartments to accommodate wires that carry different operating voltages along the length of the channel, and a third compartment for supporting either a luminaire or a track section. The through wires in the first and second compartments are run respectively to the luminaire and track sections to provide the appropriate operating voltages to the lighting fixtures supported by the channel.

5 Claims, 8 Drawing Sheets

MULTI-LYTE CHANNEL LIGHTING SYSTEM

FIELD OF THE INVENTION

The present invention relates generally to lighting systems, and more particularly to a unitary lighting system that provides both general lighting and accent lighting.

BACKGROUND OF THE INVENTION

In many locations, it is often considered desirable to be able to provide indirect and/or direct general or ambient lighting as well as track or accent lighting. Combined illumination of this nature is often used, for example, in an architect's office or in a house in which accent lighting is used to highlight a selected area, such as one on which a painting is hung, or in a commercial establishment to highlight or concentrate light on merchandise offered for sale.

Ambient lighting fixtures or luminaires typically operate at one voltage, e.g. 277 volts, whereas accent or track lighting typically operates at a lower voltage, e.g. 120 volts. In a typical lighting fixture installation, a channel is secured to the ceiling and a luminaire is mounted to the channel for support and to receive electrical connection to the building electrical power supply. The known mounting channels typically, however, only provide support for a single type of lighting and do not provide more than a single operating voltage.

It is also often desirable for a lighting designer to be able to configure the building or room lighting system so as to provide the optimum combination of direct and indirect lighting as well as access lighting in certain areas. The known mounting channels have limited flexibility of use in that they are typically of a single length, and limited as to the locations and configurations in which they can be used.

SUMMARY OF THE INVENTION

It is accordingly an object of the present invention to provide a unitary lighting system that readily provides both general and accent lighting throughout a space.

It is a further object of the invention to provide a lighting system which can be readily adapted and configured for use in a variety of architectural spaces to provide general lighting, and which also allows selected areas to be highlighted by accent lighting.

It is another object of the invention to provide a lighting system that can be readily configured to adapt to a wide variety of architectural spaces and to provide a more interesting and varied visual structure in those spaces.

It is yet a further object of the present invention to provide a unitary lighting system that includes both direct or indirect luminaires as well as track lighting, in an attractive and relatively inexpensive mounting system that is easy and inexpensive to install and to use, and which can be readily modified to produce new lighting patterns.

The present invention meets these and other objects by providing a mounting channel that is suspended from the ceiling that can be used with both luminaires and track lighting. The luminaire used in the system of the invention may be of various types to provide, as desired, direct light, indirect light, or direct/indirect light. The track lighting provides accent lighting to highlight selected areas.

The mounting channel includes three compartments separated by a horizontal wall and a vertical H-shaped member.

Each compartment extends along the length of the mounting channel. Through wiring of different operating voltages or circuits can be placed in the adjoining compartments for respective connection either to one or more different types of luminaire, or to the track lighting fixture. When a luminaire is to be installed in the channel, the luminaire ballast is inserted into the lower compartment, the luminaire is secured to the underside of the channel, and the through wiring in one of the compartments is run to the ballast to connect it to the power line. When accent lighting is to be provided, a track section is placed in the lower compartment and the appropriate track wiring is run to the track.

By allowing the through-wiring to be achieved outside the lighting fixtures or modules and the track sections, the lighting modules and track sections can be spaced apart, as desired, rather than requiring separate continuous runs. Mounting channels can be connected to one another, such as by the use of end connectors of different shapes e.g. L-shaped, T-shaped, or X-shaped, so as to permit the mounting channels to be connected to one another in a desired configuration to best satisfy the requirements of the overall lighting system for general and accent lighting.

To the accomplishment of the above and to such further objects as may hereinafter appear, the present invention is directed to a unitary lighting system, substantially as defined in the appended claims and as described in the following specification, as considered with the accompanying drawings, in which:

DETAILED DESCRIPTION OF A PREFERRED EMBODIMENT

Figure 1:
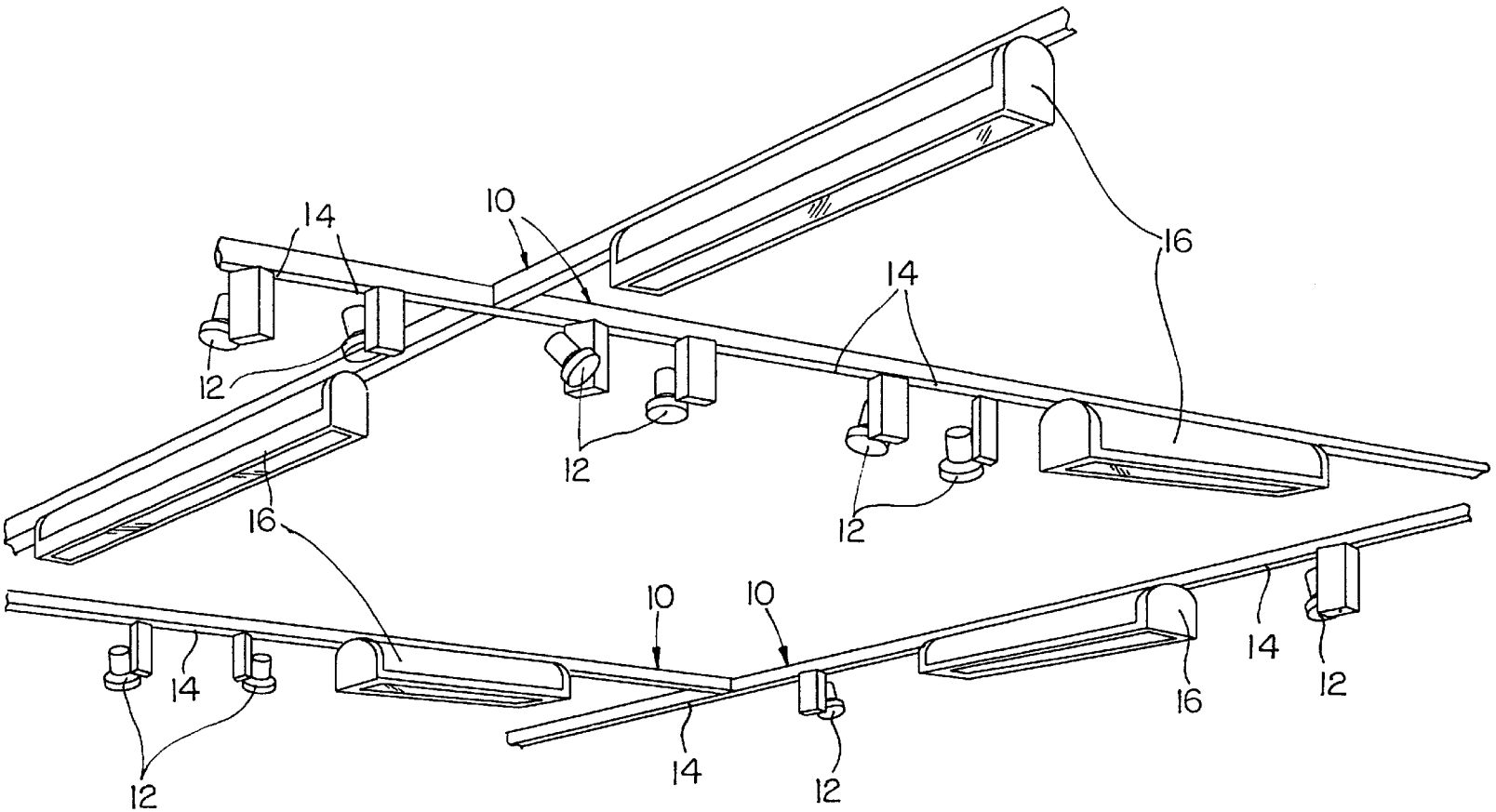
FIG. 1 is an isometric view of a lighting installation that provides combined general and accent lighting throughout a space by the use of the mounting channel of the present invention.

FIG. 1 illustrates a number of mounting channels 10, according to an embodiment of the invention, secured to one another and arranged in one of many possible configurations to provide combined general, ambient lighting, and accent lighting at desired locations so as to provide a varied visual atmosphere throughout a space such as an office. The ambient, direct or indirect lighting, may be provided by a plurality of luminaires 16, and the accent lighting may be provided by spot lights 12 affixed to a plurality of tracks 14. The luminaires 16 and the tracks 14 are mounted to the mounting tracks 10, in a manner described in greater detail below, at selected locations along the tracks 10 corresponding to the areas at which general and accent lighting, respectively, are desired. The mounting channels 10 are designed to be suspended from the ceiling at any locations along the lengths of the channels. Depending on the goals of the lighting designer, any presently available luminaire or spot light may be installed in the mounting channels.

Figure 2:
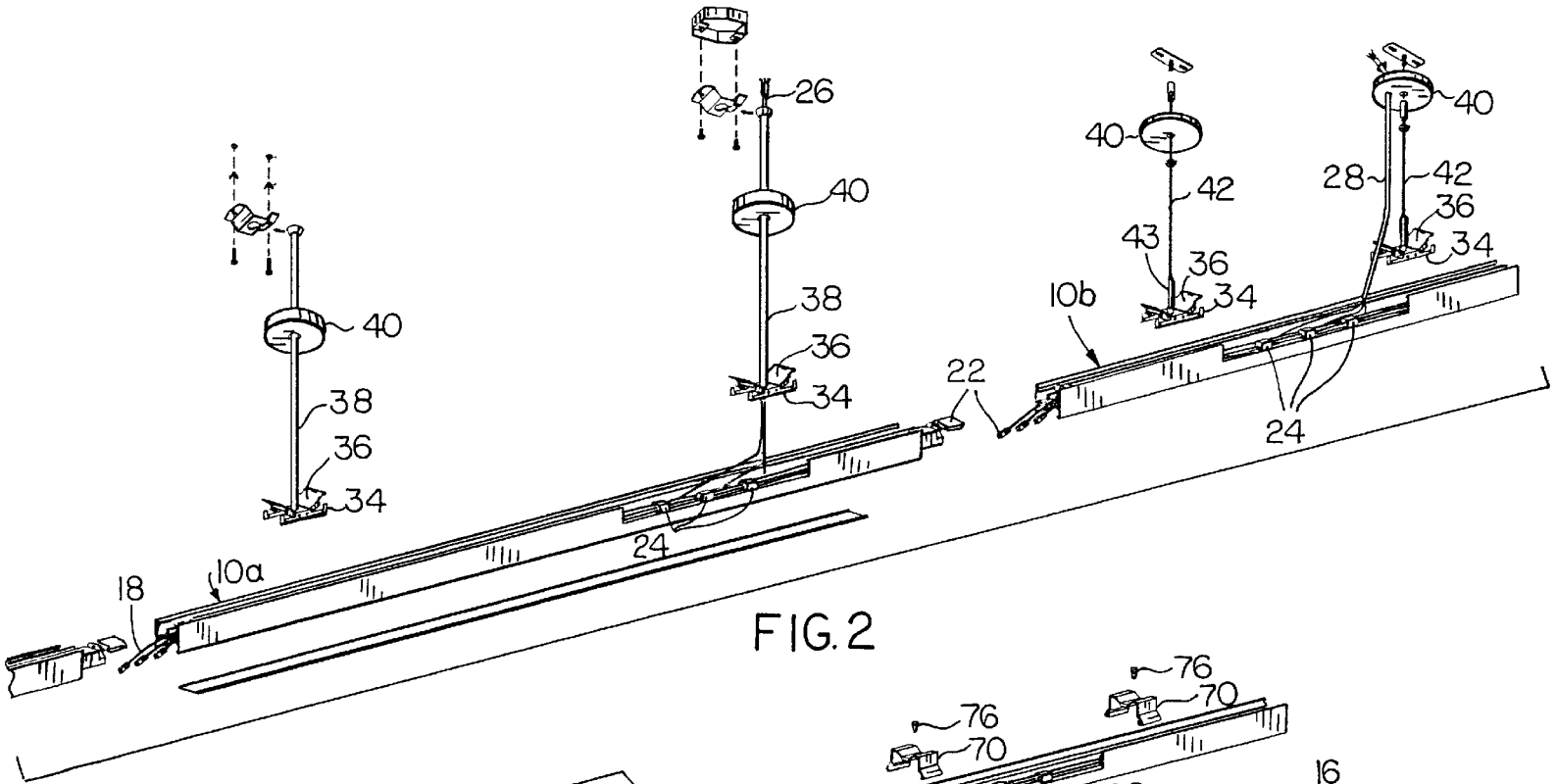
FIG. 2 is an isometric view, partly broken away, illustrating adjoining mounting channels of the invention.
Figure 4:
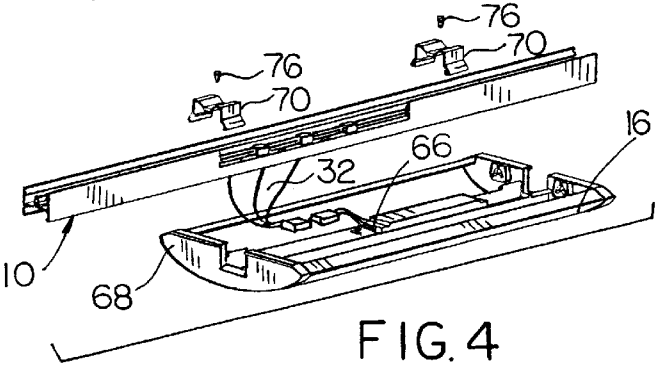
FIG. 4 illustrates the installation of a luminaire to a mounting channel.
Figure 3:
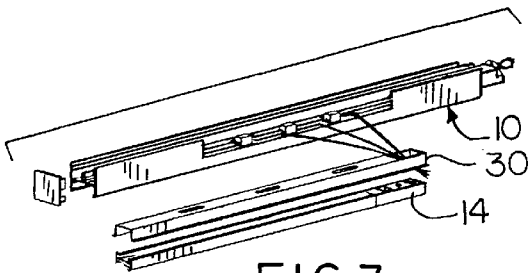
FIG. 3 illustrates one of the mounting channels of FIG. 2 illustrating the installation of a track to the channel.

Referring to FIG. 2, there are shown two mounting channels 10*a* and 10*b*, each of which embodies features of the present invention. FIG. 3 illustrates the manner of installation of a track 14 to channel 10*a*, and FIG. 4 illustrates the installation of a luminaire 16 to channel 10*b*. The installations of the luminaire and track to the mounting channels are described in greater detail in a following portion of the specification.

As shown in FIG. 2, each of the channels 10*a*, 10*b* include an elongated, typically between five and ten feet, member made of a suitable metal such as extruded aluminum. As described in greater detail below, the channel includes two upper compartments which respectively receive two sets of wire runs or conductors 18, 20, each typically consisting of three or four wires and providing different operating voltages. For the sake of clarity, only one set of conductors is illustrated in FIG. 2. The ends of the wires that extend from the channels 10 terminate at connectors 22, which permit conductors from one channel to be electrically connected to corresponding conductors in an adjoining channel, as shown in FIG. 2. Spaced along the runs of conductors are wire connectors 24 from which electrical connection to the adjacent wire runs can be made to the power supply line in the ceiling, as shown by wires 26, 28 in FIG. 2, and to the lighting fixture, that is, spot light or luminaire, as shown respectively at wires 30 in FIG. 3 and wires 32 in FIG. 4.

Figure 5B:
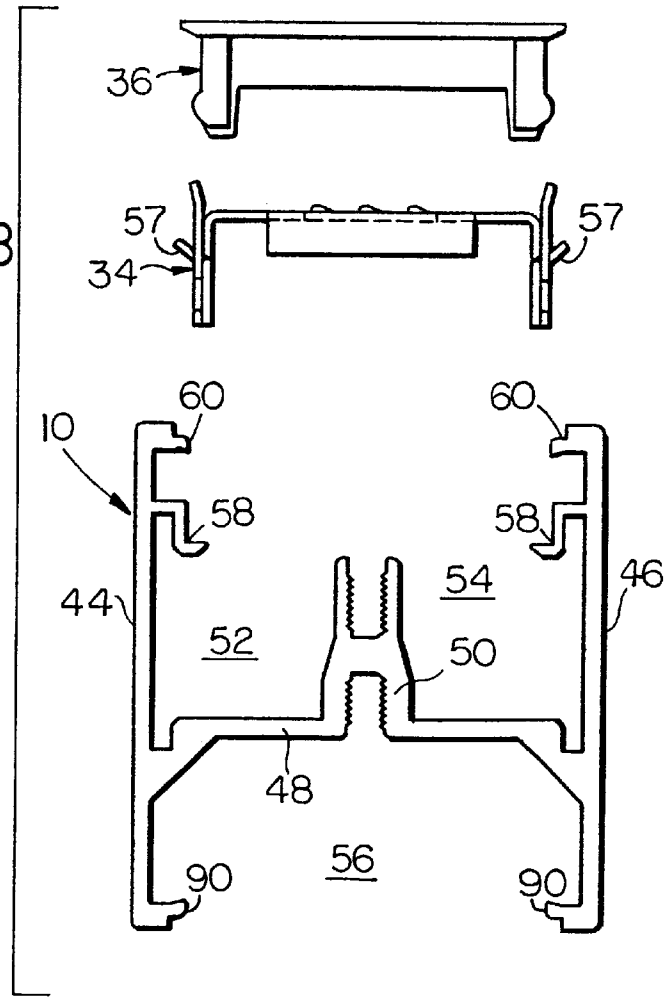
FIGS. 5A and 5B are an end view and an exploded view of a mounting channel showing the manner in which it may be mounted to a ceiling.
Figure 5A:
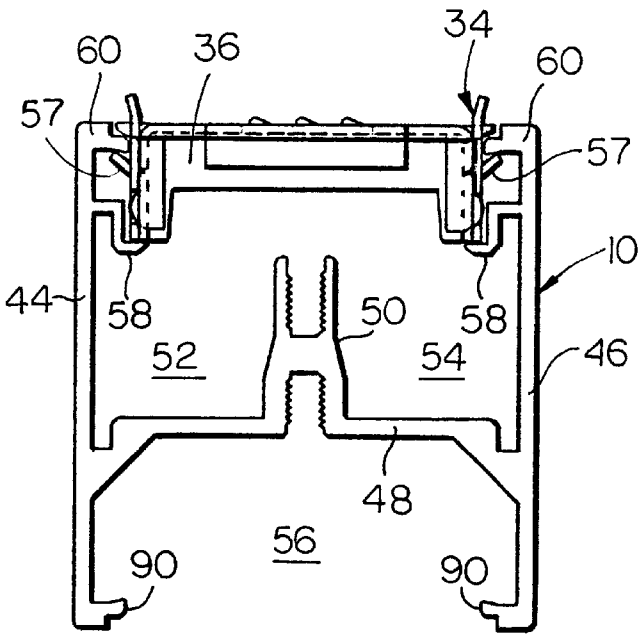

The mounting channels 10 may be secured to and suspended from the ceiling, as shown in FIGS. 2, 5A and 5B, by the attachment of a spring 34 and a latch 36 to the top section of the channel. As in mounting channel 10*a*, a stem 38 may be secured at its lower end to the spring, and its upper end is passed through a canopy 40 and secured to the ceiling by the use of conventional mounting hardware. As shown, the power line wire 26 may pass through the interior of one of the stems 38. Alternately, as in mounting channel 10*b*, a cable 42 may be secured at its lower end to the upper section of the section of the channel, and its upper end secured to the ceiling through the use of conventional hardware.

The configuration of the mounting channel 10 can be also seen with reference to FIGS. 5A and 5B. As therein shown, the channel 10 includes a pair of longitudinally extending side walls 44, 46 and a central wall 48 extending between the side walls approximately one-third of the way up from their lower ends. A vertical H-shaped member 50 extends upwardly from the middle of wall 48 to divide the upper portion of the channel into compartments 52 and 54. A lower compartment 56 is defined below wall 48 and between the lower segments of the side walls 44, 46. The upper and lower bores of the H-shaped member 50 are threaded for purposes to be described in a later portion of the specification.

As shown in FIGS. 5A, the spring 34 is snap fit into the upper part of the channel, and is locked in the channel by means of the engagement between its fingers 57 and upper fingers 60 at the upper ends of the side walls 44, 46. The lower ends of the spring 34 rest on inner projections 58 of walls 44, 46. The latch 36 is snap fit into the spring 34 to prevent the spring from snapping out of the channel.

Figure 6B:
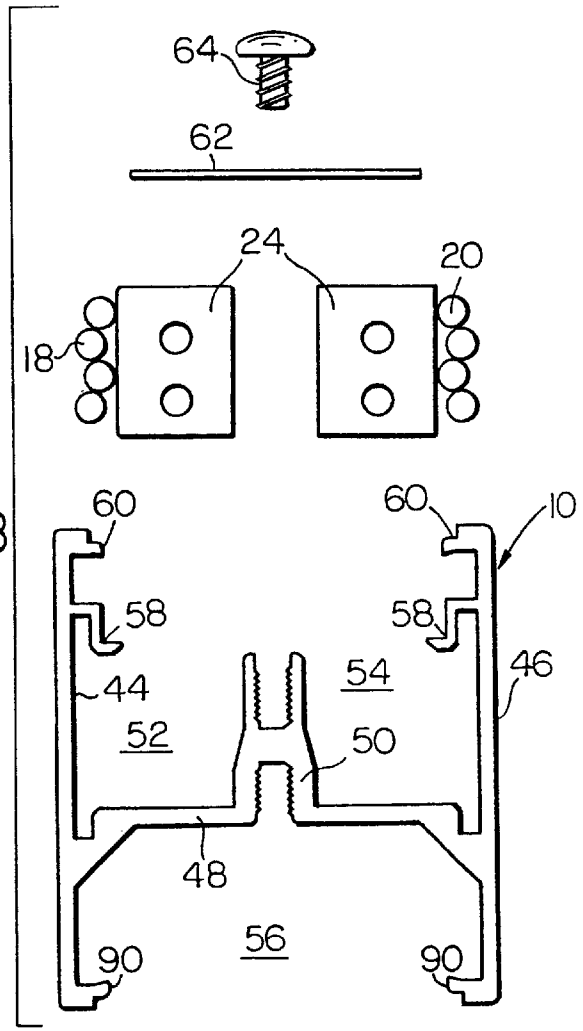
FIGS. 6A and 6B are an end view and an exploded view of the mounting channel illustrating the placement of two sets of conductors and wire connectors in the upper compartments.
Figure 6A:
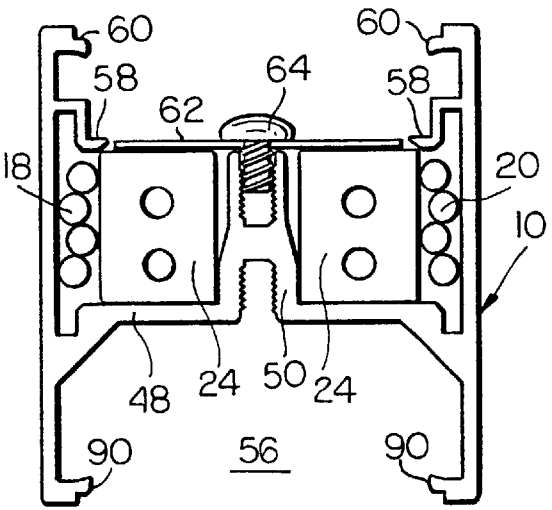

FIGS. 6A and 6B illustrates wire runs 18 and 20 respectively arranged within compartments 52, 54 and extending along the length of the mounting channel 10. As noted previously, wire connectors 24 are provided at spaced locations along the wire runs to connect the wire runs to the ceiling power line and to the track lighting and luminaires. A wire cover 62 is urged against the wires 18, 20 and connectors 24, and is secured to the channel 10 by means of a screw 64 threadably received in the upper bore section of the H-shaped member 50. As seen best in FIG. 6A, H-shaped member 50 separates and serves as a barrier between chamber 52 and chamber 54 so that one voltage, typically 120 volts, can be applied to one of the wire runs 18, while a second voltage, typically 277 volts may be applied to the other wire run 20.

Figure 7B:
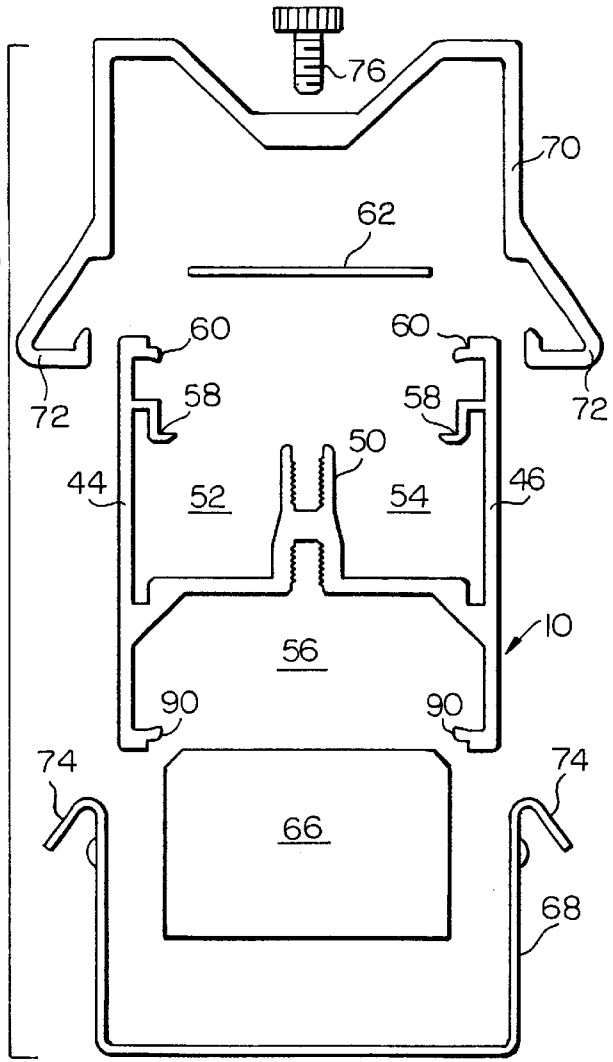
FIGS. 7A and 7B are an end view and an exploded view of the mounting channel of the invention illustrating its use to install a luminaire.
Figure 7A:
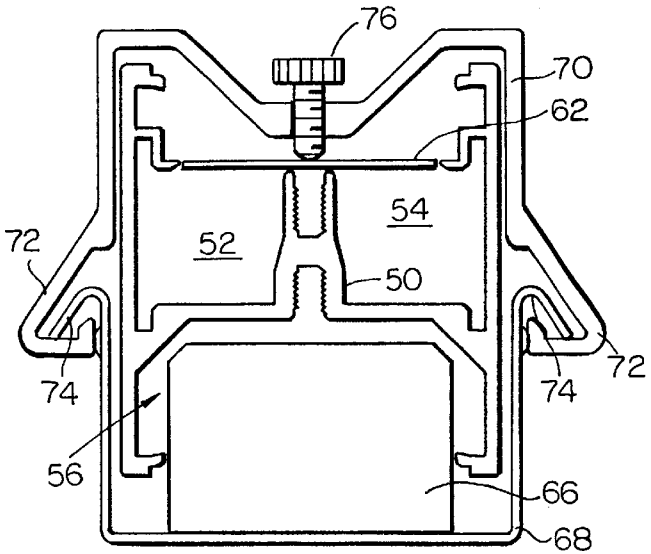

FIGS. 7A and 7B illustrate the manner of installing a luminaire 16 to one of the mounting channels. For purposes of clarity, only the ballast 66 and chassis 68 of the luminaire are shown in FIGS. 7A and 7B. As therein shown, the outer walls of the luminaire chassis are disposed about the lower ends of the channel side walls 44, 46 so that ballast 66 is received within the lower compartment 56. A mounting clip 70 is placed over the upper end of the channel so that its flared hooked flanges 72 engage the upper curved ends of the chassis 68 as seen in FIG. 7A, thereby to secure the luminaire chassis to the channel. A knurled knob 76 passes through an opening in the mounting clip 70 and is hand-tightened into place until, as shown in FIG. 7A, it contacts the wire cover 62, which extends along the length of the channel above compartments 52, 54, and is positioned over the through wires (not shown in FIG. 7A) extending through the channel compartments. As the knob 76 is further tightened, wire cover 62 is urged downwards by the knob 76 against the wires, and the luminaire chassis 68 is caused to be raised upwards into the channel 10.

Figure 8B:
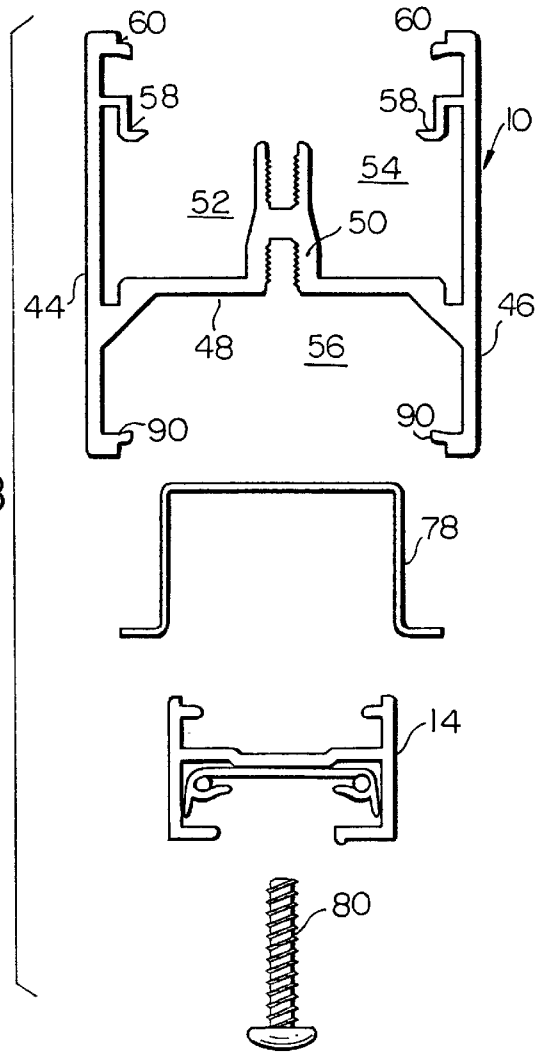
FIGS. 8A and 8B are an end view and an exploded view of the mounting channel of the invention illustrating its use to install a track where accent lighting is desired.
Figure 8A:
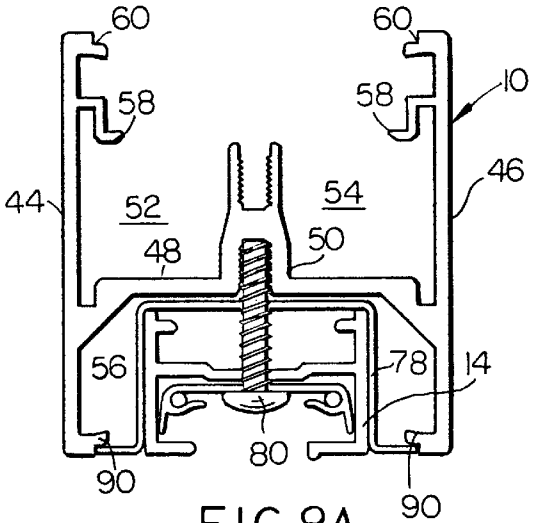

FIGS. 8A and 8B illustrate the manner of installing a track lighting section to a mounting channel. As therein shown, a track adapter 78 is inserted into the lower compartment 56 of the channel, and in turn, a track 14 is inserted into the interior of the adapter. Adapter 78 and the track 14 are secured to the mounting channel by means of a screw 80 passing through the track and adapter and threadably received in the lower threaded bore of H-shaped member 50.

Figure 9B:
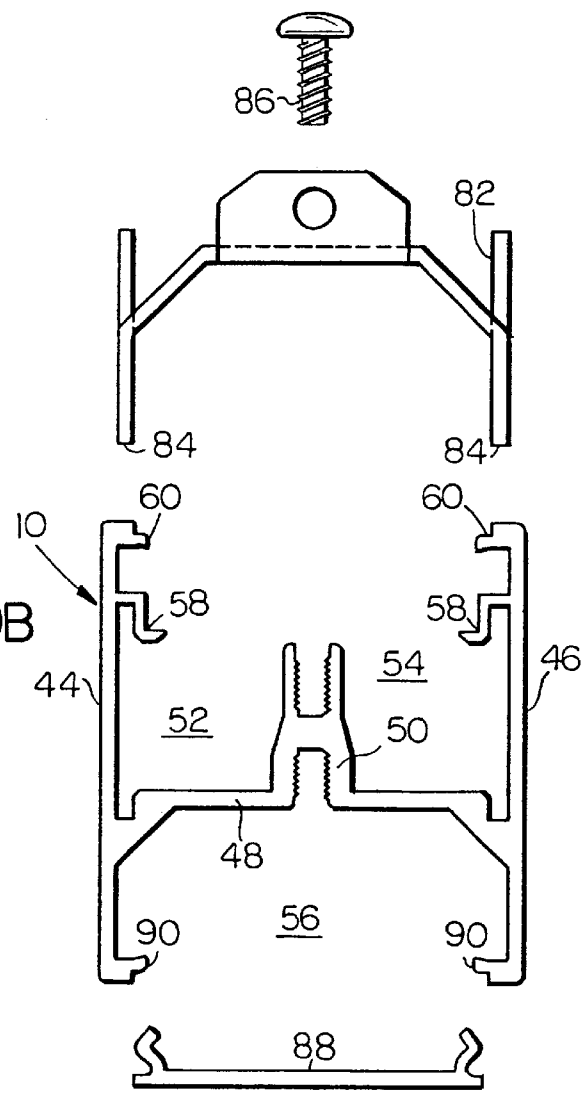
FIGS. 9A and 9B are an end view and an exploded view of a mounting channel as configured at a location at which neither a luminaire nor a track is to be installed.
Figure 9A:
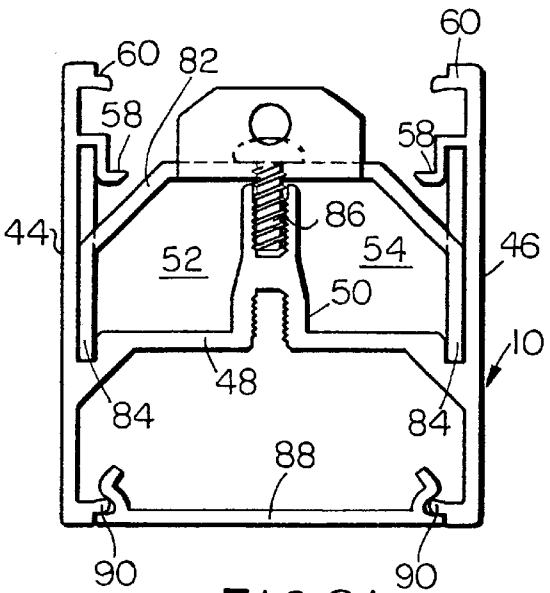

At those sections of the lighting installation at which a channel is present but no luminaire or track is to be installed, a spline 82 is snap fit into the upper end of the channel. Its lower ends are, as shown in FIG. 9A, received in groove 84 at the ends of wall 48, and its upper ends are snapped into engagement with channel fingers 58. The spline 82 is secured to the channel by means of a screw 86 passing through the spline and threadably received in the upper threaded bore of H-shaped member 50. A bottom cover 88 is snap fit at the lower end of the channel and engages fingers 92 at the lower ends of channel side walls 44, 46. The spline 82 may extend across two adjoining channels so as to join those channels together along their lengths.

Figure 10:
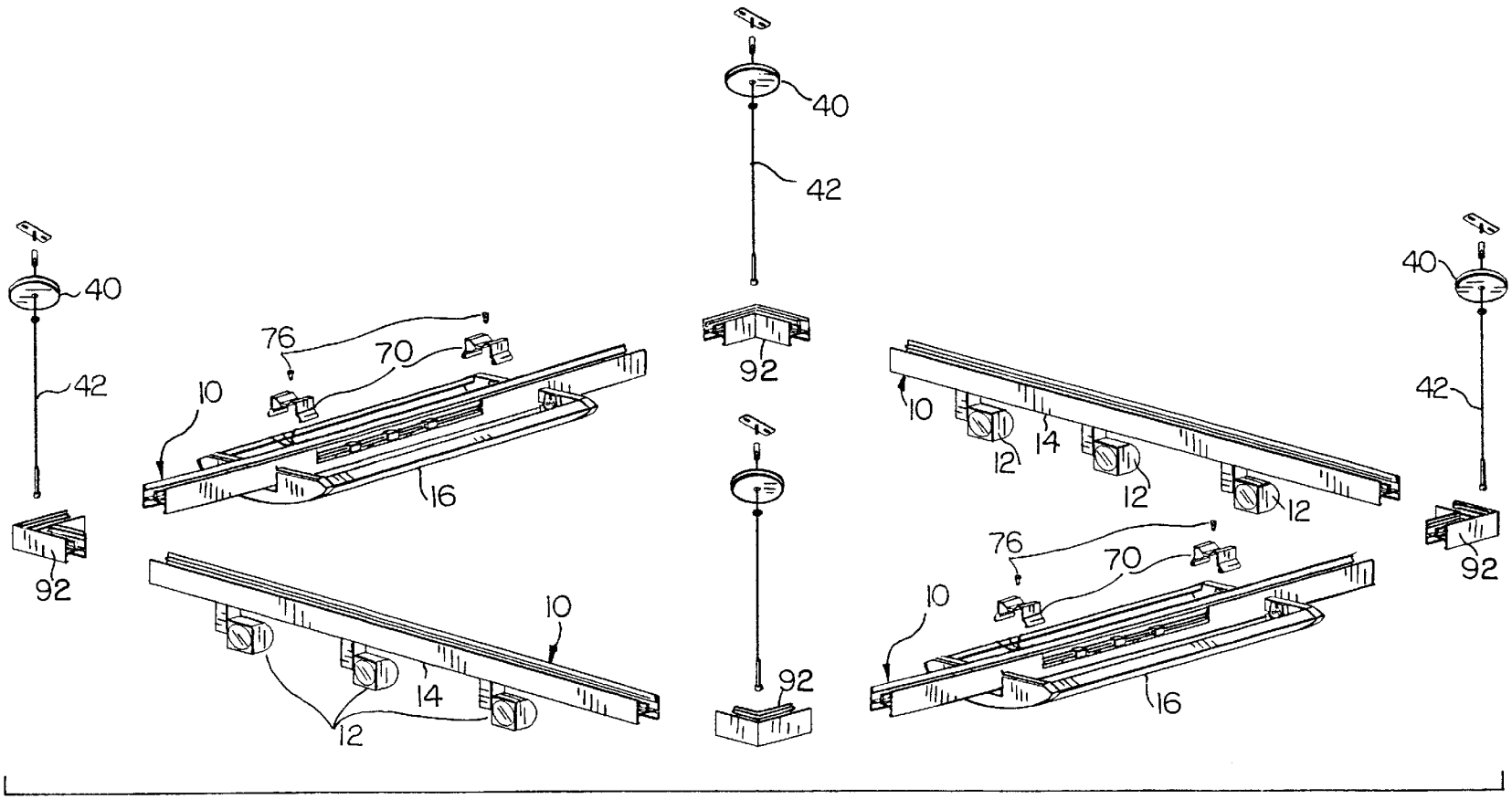
FIG. 10 is an isometric view illustrating the manner in which a number of mounting channels can be connected together in a desired configuration.

The ends of the adjoining channels can be secured to one another either along a common axis or, as shown in FIG. 10, by the use of L-shaped end connectors 92 suspended from the ceiling by cables 42 such that adjoining channels form right-angle connections with one another. If desired, to achieve other configurations of the channels, X-shaped and T-shaped end connectors (not shown) may be used to connect adjoining mounting channels at the desired orientation relative to one another. In this manner, a number of mounting channels 10 can be connected together in a wide variety of configurations to provide the desired combination of general and accent lighting to the space. Since the lighting elements, to wit, the luminaires and accent spot lights, can be located at any point on the mounting channels used to configure the system, the system can be readily modified to meet the changing needs of the lighting designer.

It will be appreciated that although the invention has been hereinabove described with regard to a specific embodiment,

What is claimed is:

1. A channel for use in mounting first and second lighting fixtures for respectively providing accent and general lighting, said channel comprising an elongated channel member having first and second vertical side walls, a transverse wall extending between said side walls, and a barrier member extending vertically from said transverse wall to define first and second compartments extending along the length of said channel, said barrier member is H-shaped and includes upper and lower threaded bores, and a third compartment extending along the length of said channel at the lower end of said transverse wall and between said side walls, said first and second compartments being respectively adapted to run first and second sets of conductors therethrough, said third compartment being adapted to receive one of said first and second lighting fixtures.

2. A channel for use in mounting first and second lighting fixtures for respectively providing accent and general lighting, said channel comprising an elongated channel member having first and second vertical side walls, a transverse wall extending between said side walls, and a barrier member extending vertically from said transverse wall to define first and second compartments extending along the length of said channel, and a third compartment extending along the length of said channel at the lower end of said transverse wall and between said side walls, said first and second compartments being respectively adapted to run first and second sets of conductors therethrough, said third compartment being adapted to receive one of said first and second lighting fixtures, connector means spaced along said first and second compartments for respectively connecting said first and second lighting fixtures to one of said sets of conductors that carry the proper operating voltage, one of said lighting fixtures is a luminaire and the other of said lighting fixtures is a track lighting fixture.

3. A channel for use in mounting first and second lighting fixtures for respectively providing accent and general lighting, said channel comprising an elongated channel member having first and second vertical side walls, a transverse wall extending between said side walls, and a barrier member extending vertically from said transverse wall to define first and second compartments extending along the length of said channel, and a third compartment extending along the length of said channel at the lower end of said transverse wall and between said side walls, said first and second compartments being respectively adapted to run first and second sets of conductors therethrough, said third compartment being adapted to receive one of said first and second lighting fixtures, connector means spaced along said first and second compartments for respectively connecting said first and second lighting fixtures to one of said sets of conductors that carry the proper operating voltage, one of said lighting fixtures is a luminaire and the other of said lighting fixtures is a track lighting fixture, and means secured to the upper section of said channel member for suspending the channel from a ceiling.

4. A channel for use in mounting first and second lighting fixtures for respectively providing accent and general lighting, said channel comprising an elongated channel member having first and second vertical side walls, a transverse wall extending between said side walls, and a barrier member extending vertically from said transverse wall to define first and second compartments extending along the length of said channel, and a third compartment extending along the length of said channel at the lower end of said transverse wall and between said side walls, said first and second compartments being respectively adapted to run first and second sets of conductors therethrough, said third compartment being adapted to receive one of said first and second lighting fixtures, at least one luminaire and at least one track section, first means for securing said luminaire to said channel at one location, and second means for securing said track section to said channel at a second location along said channel, and connector means spaced along said first and second compartments for respectively connecting said first and second lighting fixtures to one of said sets of conductors that carry the proper operating voltage.

5. A channel for use in mounting first and second lighting fixtures for respectively providing accent and general lighting, said channel comprising an elongated channel member having first and second vertical side walls, a transverse wall extending between said side walls, and a barrier member extending vertically from said transverse wall to define first and second compartments extending along the length of said channel, and a third compartment extending along the length of said channel at the lower end of said transverse wall and between said side walls, said first and second compartments being respectively adapted to run first and second sets of conductors therethrough, said third compartment being adapted to receive one of said first and second lighting fixtures, at least one luminaire and at least one track section, first means for securing said luminaire to said channel at one location, and second means for securing said track section to said channel at a second location along said channel, connector means spaced along said first and second compartments for respectively connecting said first and second lighting fixtures to one of said sets of conductors that carry the proper operating voltage, and means secured to the upper section of said channel member for suspending the channel from a ceiling.

* * * * *